US005461396A

United States Patent [19]

Nakatani et al.

[11] Patent Number: 5,461,396

[45] Date of Patent: Oct. 24, 1995

[54] FLAT-TYPE PICTURE DISPLAY APPARATUS

[75] Inventors: Toshifumi Nakatani, Moriguchi; Kanji Imai, Takatsuki; Tomohiro Sekiguchi, Kobe, all of Japan

[73] Assignee: Matsushita Electric Industrial Co., Ltd., Osaka, Japan

[21] Appl. No.: 247,440

[22] Filed: May 23, 1994

[30] Foreign Application Priority Data

May 26, 1993 [JP] Japan ..... 5-123927
Jul. 28, 1993 [JP] Japan ..... 5-186038

[51] Int. Cl.[6] ..... G09G 3/20

[52] U.S. Cl. ..... 345/75; 313/497

[58] Field of Search ..... 345/74, 75; 348/798; 313/293–304, 495, 497

[56] References Cited

U.S. PATENT DOCUMENTS 4,623,882 11/1986 Nixon ..... 345/75
4,955,681 9/1990 Sekihara et al. ..... 313/495
5,003,219 3/1991 Muragishi et al. ..... 313/456

FOREIGN PATENT DOCUMENTS 0316871 5/1989 European Pat. Off. .
0487936 6/1992 European Pat. Off. .
0261948 3/1990 Japan .

*Primary Examiner*—Jeffery Brier
*Attorney, Agent, or Firm*—Panitch Schwarze Jacobs & Nadel

[57] ABSTRACT

In a flat-type picture display apparatus having a back electrode, plural linear cathodes, an electron beam extraction electrode, a signal electrode, a focusing electrode, a pair of horizontal deflection electrodes and a pair of vertical deflection electrodes which are disposed in a space between a front glass plate and a back glass plate, vertical deflection electrodes, horizontal deflection electrodes and/or focusing electrode are/is provided to extend beyond the border line of the electron beam passing area of a television picture screen to produce same equipotential surface on each unit for one picture element in the television picture screen.

9 Claims, 9 Drawing Sheets

FLAT-TYPE PICTURE DISPLAY APPARATUS

FIELD OF THE INVENTION

The present invention relates to a flat-type picture display apparatus as a picture reproducer having a flat picture.

BACKGROUND OF THE INVENTION

Heretofore, a cathode-ray tube has mainly used as color television picture display apparatus. The cathode-ray tube has considerably large depth in comparison with size of its television picture screen face. Hence it has been impossible to make a flat-type picture display apparatus with such cathode-ray tube. Recently, picture display apparatus of various types, such as an EL(electroluminescence) display device, a plasma display device or a liquid crystal display device etc. have been developed to offer the flat-type picture display apparatus. However, none of them has been able to offer satisfactory performance, such as luminance, contrast, pixel number and color reproducibility.

Then, a flat-type picture display apparatus having high quality performance has been developed by employing electron beams, and such flat-type picture display apparatus is disclosed in the gazette of the Japanese unexamined patent application No. Sho 62-288762 (publication No. Tokkai Hei 1-130453) which was filed by the same assignee as the present invention.

The gazette No. Tokkai Hei 1-130453 discloses that a television picture screen is divided horizontally and vertically into the matrix arrangement of plural small segments, and each of the small segments is scanned by deflecting one electron beam which is separated from the other electron beams. And, fluorescent dots of R(red), G(green) and B(blue) for one picture element in the small segment are shot in turn by the electron beam of which an amount of the irradiation is controlled by color picture signals. As a result, television moving pictures as a whole are reproduced on the television picture screen by arranging all small segments.

FIG.8 is an exploded perspective view showing an internal conventional picture display apparatus. As shown in FIG.8, plural electrodes are stored in an inside space of an enclosure between a front glass plate 8 and a back glass plate 9 as an envelope of the flat-type picture display apparatus. The plural electrodes comprise a back electrode 1, linear cathodes 2*a*, 2*b* and 2*c* as electron beam sources, an electron beam extraction electrode 3, signal electrodes 4, a focusing electrode 5, horizontal deflection electrodes 6 and vertical deflection electrodes 7. And, the inside space of the enclosure between the front glass plate 8 and the back glass plate 9 is evacuated.

The back electrode 1 is made of a flat plate-shaped conductor, and disposed in parallel with the linear cathodes 2*a*, 2*b* and 2*c*.

The plural linear cathodes 2*a*, 2*b* and 2*c* (only 3 pieces are shown in FIG. 8.) are extended in the horizontal direction, and parallelly disposed to each other in the vertical direction so that electron-flow of nearly uniform current-density-distribution is produced in the horizontal direction. These linear cathodes 2*a*, 2*b* and 2*c* are constituted by, for example, coating an oxide cathode material on the surface of tungsten wires.

The electron beam extraction electrode 3, which is made of a conductive plate, is disposed to face the back electrode 1 across the linear cathodes 2*a*, 2*b* and 2*c*. Plural through-holes 10 are formed in the electron beam extraction electrode 3, and aligned in the horizontal direction to have regular intervals to correspond to each linear cathodes 2*a*, 2*b* and 2*c*. Electron streams, which are produced by the linear cathodes 2*a*, 2*b* and 2*c*, are extracted as electron beams in a front direction toward the front glass plate 8 by the potential between the back electrode 1 and the electron beam extraction electrode 3.

The signal electrodes 4 comprises plural oblong conductive plates which are elongated in the vertical direction and aligned in the horizontal direction at predetermined intervals. Plural through-holes 13 are formed in each of the conductive plates at the positions which correspond to the through-holes 10 of the electron beam extraction electrode 3. The through-holes 13 of the signal electrodes 4 are similar in shape to the through-holes 10 of the electron beam extraction electrode 3. The signal electrodes 4 are provided to deflect the electron beams 17 in response to picture signals from external unit, and thereby the electron beams 17 irradiate a definite position of a fluorescent material layer, and the fluorescent material layer emits light of the designated color at a desired luminance.

The focusing electrode 5 is made of a conductive plate and has plural through-holes 14 at the positions which correspond to the through-holes 13 of the signal electrodes 4. The focusing electrode 5 is provided to focus the electron beams 17 at a desired point of the fluorescent material layer.

The horizontal deflection electrodes 6 comprises a pair of conductive plates 16*a* and 16*b* having oblong strips elongated in the vertical direction. These oblong strips are disposed to each other on a common plane so that these oblong strips are aligned in parallel with each other in the vertical direction. An aperture between the oblong strips is arranged in parallel with a vertical center line of the through-hole 14 of the focusing electrode 5. The two conductive plates 16*a* and 16*b* are used as a pair of the horizontal deflection electrodes 6. The conductive plates 16*a*, 16*b* are formed into comb-shaped having comb-teeth parts, respectively. And a pair of the comb-teeth parts are alternatively aligned to face in the vertical direction as shown in FIG.8.

The vertical deflection electrodes 7 comprise a pair of conductive plates 18*a* and 18*b* which are formed into a comb-shape, respectively. The conductive plates 18*a*, 18*b* are disposed to each other on a common plane so that the conductive plates 18*a*, 18*b* are aligned in parallel with each other in the horizontal direction as shown in FIG.8. Respective aperture along with the horizontal line between the conductive plates 18*a* and 18*b* is aligned in parallel with a horizontal center line of the through-holes 14 aligned in a line. The conductive plates 18*a*, 18*b* are aligned opposing their long horizontal members each other as shown in FIG.8. In other words, two comb-shaped parts of the conducting plates 18*a*, 18*b* are mutually engaged keeping an adequate spacing as a pair of the vertical deflection electrodes 7.

A television picture screen 19 is constituted by coating a fluorescent material layer on the inner face of the front glass plate 8, and then by adding a metal-back layer (not shown in the figure). Thereonto, the fluorescent material layer emits light of R(red), G(green) and B(blue) by the irradiation of electron beams 17.

The electron beams 17, which are emitted from the surface of the linear cathodes 2*a*, 2*b* and 2*c*, pass through the through-holes 10 of the electron beam extraction electrode 3, the through-holes 13 of the signal electrode 4 and the through-holes 14 of the focusing electrode 5. And the electron beams 17 collides through the horizontal deflection electrodes 6 and the vertical deflection electrodes 7 with the metal-back layer to make fluorescent material layer emit light.

FIG.9 is a schematic plan view of the television picture screen 19 of the conventional flat-type picture display apparatus as disclosed in Tokkai Hei 1-130453. As shown in FIG.9, the television picture screen 19 has a picture effective area A for displaying a picture by irradiating the electron beams 17 on the television picture screen 19, and a non-picture effective area B which does not display a picture. The non-picture effective area B, which is shown by a cross-hatching in FIG.9, is produced on an edge portion of the television picture screen 19. In the picture effective area A of the television picture screen 19, the fluorescent material layer is irradiated by the electron beams 17 to emit light for displaying pictures in the small segment 21. An electron beam passing area E, which is within the picture effective area A, is a portion effectively irradiated by the electron beams 17 having passed through the through-holes 10, 13 and 14 of the plural electrodes 3, 4 and 5, and vertical border lines α and horizontal border lines α of the electron beam passing area E are shown with chain lines α in FIG.9.

Hereinafter, a set of the components for displaying one picture element in the small segment 21 is defined to one unit. Namely, the one unit comprises a part of the back electrode 1, the linear cathode 2*a*, 2*b* or 2*c*, the electron beam extraction electrode 3, the signal electrode 4, the focusing electrode 5, the horizontal deflection electrodes 6 and the vertical deflection electrodes 7 and the television picture screen 19 for displaying one picture element.

In the above-mentioned conventional flat-type picture display apparatus, since it is not necessary for the electron beams 17 to trace in the outside of the electron beam passing area E, a pair of the conductive plates 16*a*, 16*b* of the horizontal deflection electrodes 6, a pair of the conductive plates 18*a*, 18*b* of the vertical deflection electrodes 7 and the through-hole 14 of the focusing electrode 5 are not provided in the outside of the electron beam passing area E.

However, the above-mentioned conventional flat-type picture display apparatus has different electric fields between the unit for a center portion of the picture effective area A and the unit for an edge portion of the picture effective area A. Therefore, each equipotential surface in the center portion and the edge portion of the picture effective area A has different shape.

FIG. 10 is a cross sectional view showing a part of the horizontal deflection electrodes 6 in the conventional flat-type picture display apparatus. FIG. 11 is an enlarged sectional view of the horizontal deflection electrode of FIG. 10. In the conventional horizontal deflection electrodes 6, the apertures between a pair of the conductive plates 16*a* and 16*b* are disposed in the only electron beam passing area E. The end aperture is arranged at the border line α of the electron beam passing area E. When the electron beams 17 are not deflected by the above-mentioned horizontal deflection electrodes 6, wave-shaped equipotential surface as shown in FIGS. 10 and 11 is produced on the horizontal deflection electrodes 6. The equipotential surface on the edge portion of the electron beam passing area E, that is, the end aperture at the border line a of the electron beam passing area E, has a different formation from the next aperture of the electron beam passing area E as shown in FIG. 11. As mentioned-above, since the equipotential surface has different formations between the edge portion and the center portion, the tracks of the electron beams 17 from the linear cathodes 2*a*, 2*b* and 2*c* vary between the unit in the edge portion and the unit in the center portion. In other words, the track of the electron beams 17 at the border line α of the electron beam passing area E is not formed to be parallel with the track in the center portion of the television picture screen 19. FIG. 12 is a plan view showing a part of the television picture screen of the conventional flat-type picture display apparatus. As shown in FIG. 12, in the edge portion of the picture effective area A, the electron beams 17 for the adjacent units in the edge portion are mixed and irradiate the television picture screen 19, thereby a brightening portion C and dark portion D comparison with the circumference thereof are produced in the picture effective area A. Accordingly, the conventional flat-type picture display apparatus can not display pictures which have excellent uniformity.

FIG. 13 is a perspective view of the conventional flat-type picture display apparatus. FIG. 14 is a cutaway perspective view showing a part of the conventional flat-type picture display apparatus. As shown in FIGS. 13 and 14, a exhaust pipe 30 and a high voltage terminal 31 are provided on the edge of the front glass plate 8, and further securing screws 32 and plural output terminals for external units are disposed in the space adjacent to the edge of the plane electrodes. Therefore, the electric field distribution in the edge portion of the television picture screen 19 is affected by existence of these devices thereby disturbing the electric field distribution.

OBJECT AND SUMMARY OF THE INVENTION

The object of the present invention is to offer a flat-type picture display apparatus which can display high quality picture in whole picture elements of the television picture screen.

In order to achieve the above-mentioned object, the flat-type picture display apparatus in accordance with the present invention comprises:

a back glass plate, a front glass plate disposed substantially in parallelism with the back glass plate with a predetermined gap therebetween thereby defining a vacuum chamber therebetween for containing the following electrodes;

plural linear cathodes which are for emitting electron beams, extended in parallel with each other and disposed substantially on a virtual plane which is disposed in parallelism with the back glass plate with a predetermined gap thereto;

a back electrode which is disposed in back side of the linear cathodes in parallelism with the virtual plane and the linear cathodes so as to be between the virtual plane and the back glass plate;

an electron beam extraction electrode which is disposed in front side of the linear cathodes, has a number of electron beam passing holes and is for extracting electron beams forward from the linear cathodes and passing them through their electron beam passing holes thereby defining an electron beam passing area;

signal electrodes which are disposed in front side of the electron beam extraction electrode and is for controlling a passing amount of electron beams having passed through the electron beam extraction electrode;

a focusing electrode which is disposed in front side of the signal electrodes and is for focusing electron beams having passed through the signal electrodes;

a horizontal deflection electrodes pair is for horizontally deflecting electron beams having passed through the signal electrodes, and extends beyond a border line of the electron beam passing area;

a vertical deflection electrodes pair is for vertically deflecting electron beams having passed through the horizontal deflection electrodes pair; and a fluorescent screen disposed on the inner face of the front glass plate.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENT

Hereafter, preferred embodiments of the present invention are described with reference to the accompanying drawings.

First embodiment

Figure 1:
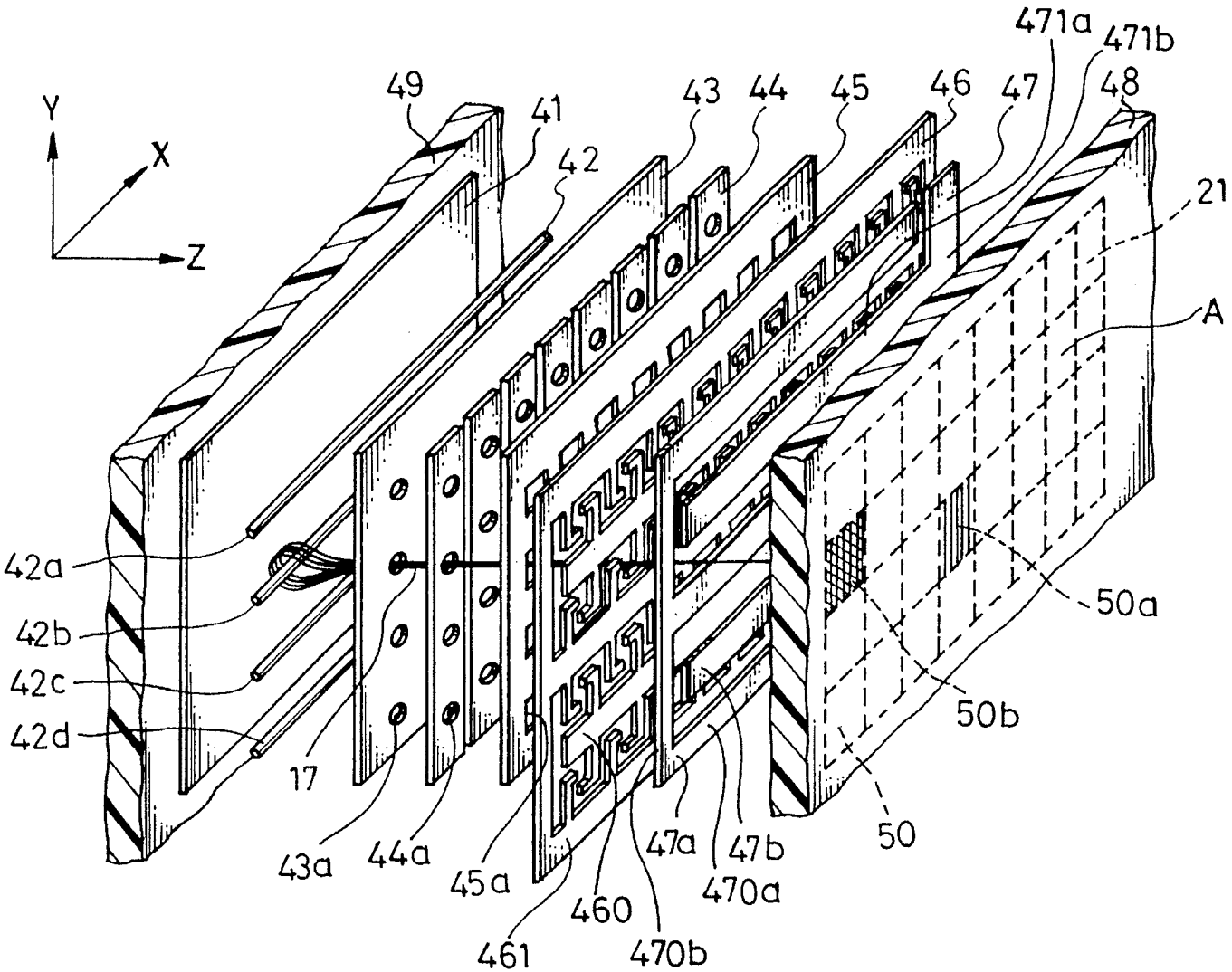
FIG. 1 is an exploded perspective view showing an internal flat-type picture display apparatus of a first embodiment of the present invention.
Figure 13:
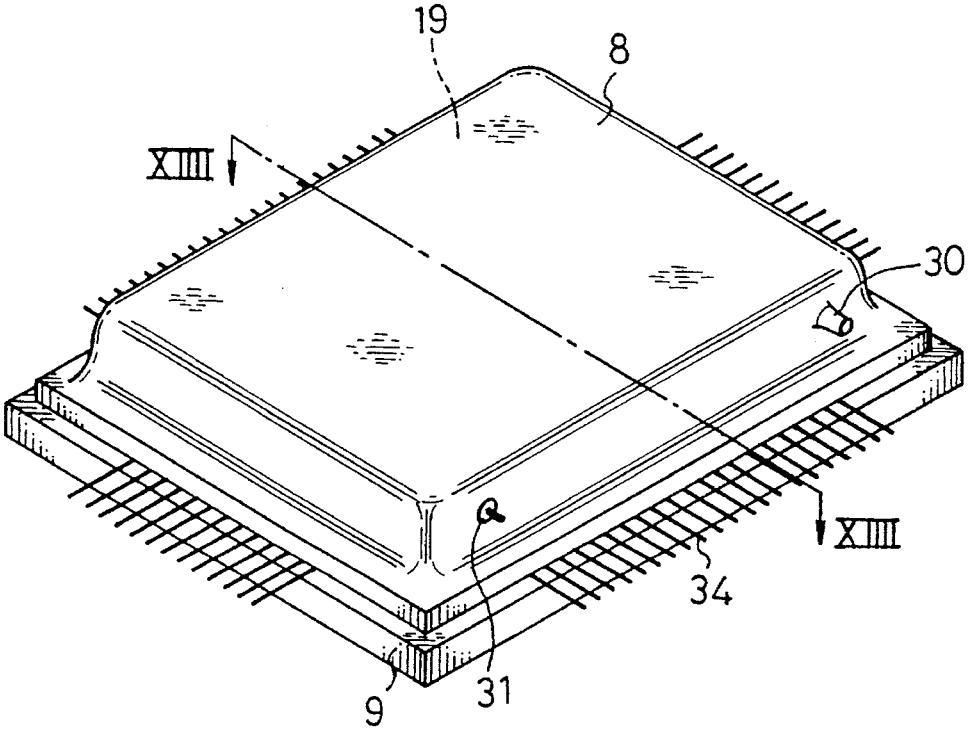
FIG.13 (Prior Art)
FIG. 13 is the perspective view of the conventional flat-type picture display apparatus.
Figure 14:
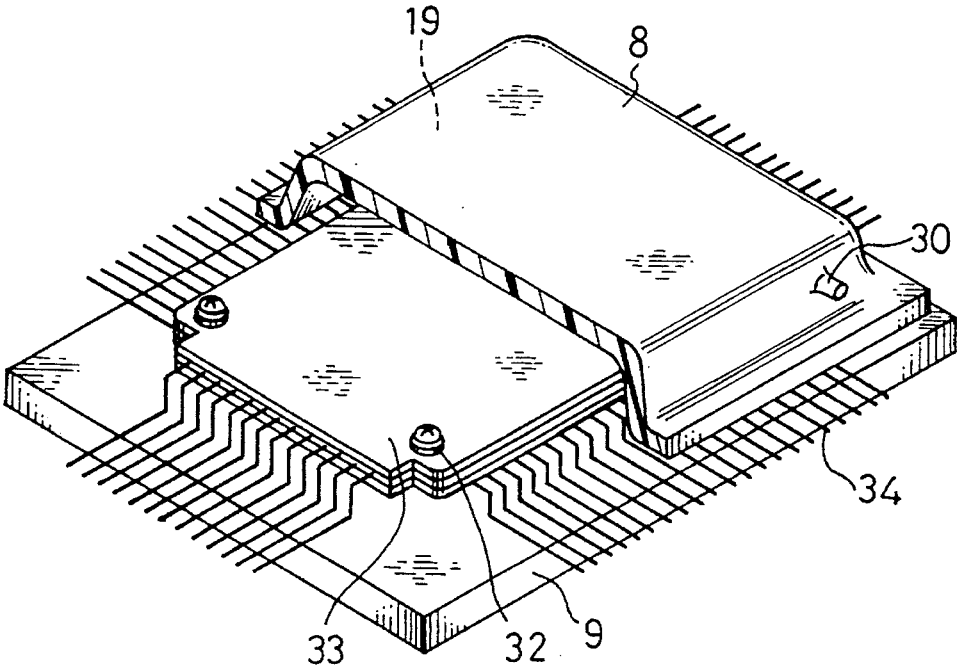
FIG.14 (Prior Art)
FIG. 14 is the cutaway view showing a part of the conventional flat-type picture display apparatus.

FIG. 1 is an exploded perspective view showing an internal flat-type picture display apparatus of a first embodiment. A back electrode 41, linear cathodes 42*a*, 42*b*, 42*c* and 42*d*, an electron beam extraction electrode 43, a signal electrode 44, a focusing electrode 45, a pair of horizontal deflection electrodes 46, and a pair of vertical deflection electrodes 47 are disposed in an space between a front glass plate 48 and a back glass plate 49. An envelope of the flat-type picture display apparatus is constructed by the front glass plate 48 and the back glass plate 49 which are coupled to contain the above-mentioned electrodes as shown in FIGS. 13 and 14. A television picture screen 50 is provided on a rear surface of the front glass plate 48. The inside space of the enclosure between the front glass plate 48 and the back glass plate 49 is evacuated. In FIG. 1, although the television picture screen 50 is divided into only 4 pieces in a vertical line and only 8 pieces in a horizontal line, the television picture screen 50 is actually divided into many small segments, such as 44 pieces in the vertical line and 221 pieces in the horizontal line, the total of 9724 pieces.

The linear cathodes 42*a*, 42*b*, 42*c* and 42*d* are parallelly disposed to each other in the vertical direction (Y-axis in FIG. 1) to have regular intervals and fixed by holding means (not shown). And each of the linear cathodes 42*a*, 42*b*, 42*c* and 42*d* is extended in the horizontal direction (X-axis in FIG. 1). Although only four pieces of the linear cathodes 42*a*, 42*b*, 42*c* and 42*d* are shown in FIG. 1, there are actually many linear cathodes (e.g. 44 pieces). The linear cathodes 42*a*, 42*b*, 42*c* and 42*d*, which are made of a tungsten wire and coated with a known cathode oxide, are provided for emitting electron beams 17.

The back electrode 41 is made of flat plate-shaped conductor and disposed in parallel with the linear cathodes 42*a*, 42*b*, 42*c* and 42*d*.

The electron beam extraction electrode 43 made of conductive sheet is disposed to oppose against the back electrode 41 across the linear cathodes 42*a*, 42*b*, 42*c* and 42*d*. Plural through-holes 43*a* are formed in the electron beam extraction electrode 43 and aligned in the horizontal direction at regular intervals to correspond to each linear cathode 42*a*, 42*b*, 42*c* and 42*d*. The electron beam extraction electrode 43 is provided for extracting electron beams 17 from the linear cathodes 42*a*, 42*b*, 42*c* and 42*d*.

The signal electrode 44 comprises plural oblong strips (e.g. 221 pieces) which are elongated in the vertical direction aligned in the horizontal direction at predetermined intervals. Plural through-holes 44*a* are formed in each of the strips of the signal electrode 44 at the positions which correspond to the through-holes 43*a* of the electron beam extraction electrode 43. The signal electrode 44 is provided for selectively controlling a passing amount of the electron beams 17 having passed through the electron beam extraction electrode 43.

The focusing electrodes 45 is made of a conductive sheet and has plural rectangular through-holes 45*a* therein. The rectangular through-holes 45*a* are arranged at the positions which correspond to the through-holes 44*a* of the signal electrode 44 and the through-holes 43*a* of the electron beam extraction electrode 43. The focusing electrode 45 is provided for electrostatically focusing the electron beams 17 having passed through the signal electrode 44.

Figure 2:
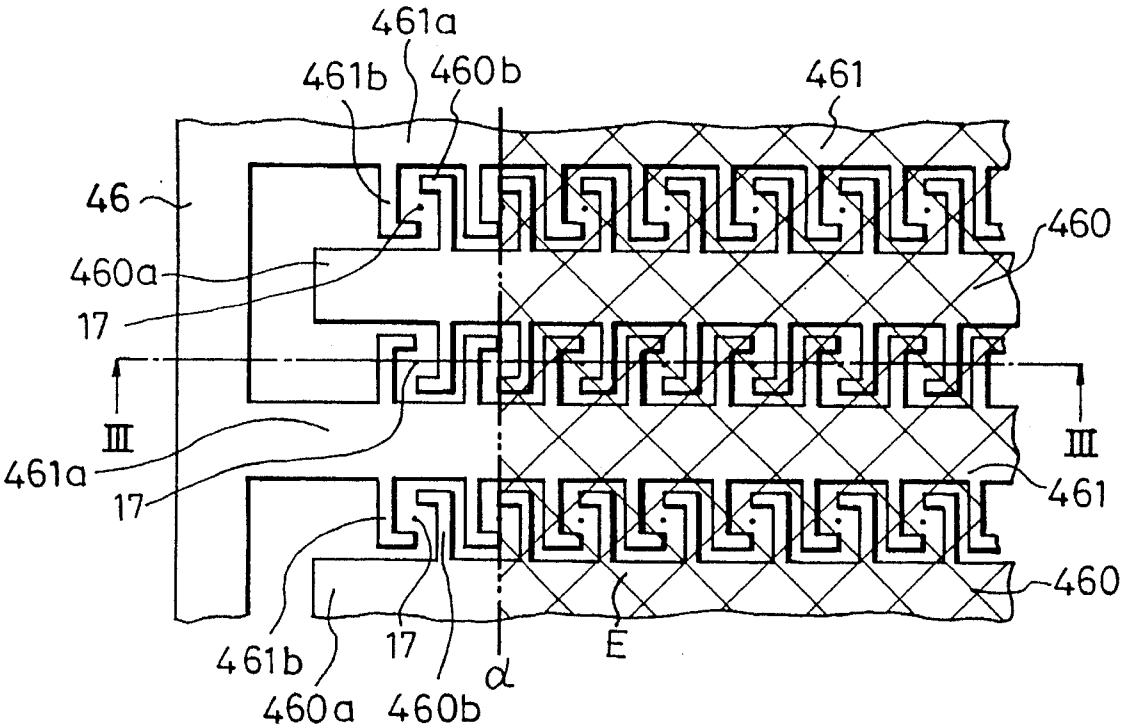
FIG. 2 is a front view showing a part of a horizontal deflection electrode of the flat-type picture display apparatus of FIG. 1.
Figure 3:
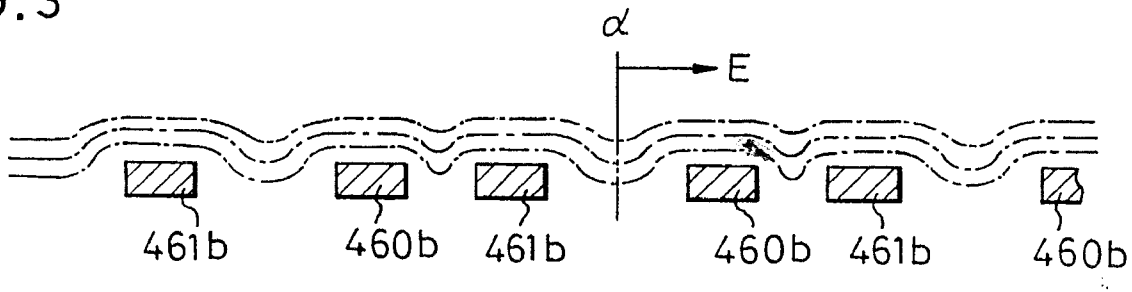
FIG. 3 is an enlarged sectional view taken on a line III—III of FIG. 2.

FIG. 2 is a front view showing a part of the horizontal deflection electrodes 46. FIG. 3 is an enlarged sectional view taken on a line III—III of FIG. 2. In FIG. 2, the horizontal deflection electrodes 46 are made of conductive sheets, and comprises a pair of conductive plates 460 and 461. One conductive plate 460 comprises stem parts 460*a* and hooked-twig parts 460*b* which are connected to the stem parts 460*a*. The other conductive plate 461 comprises stem parts 461*a* and hooked-twig parts 461*b* which are connected to the stem parts 461*a*. Both conductive plates 460 and 461 are insulatedly disposed to each other on a common X–Y plane (in FIG. 1) so that respective hooked-twig parts 460*b* and respective hooked-twig parts 461*b* are aligned opposing their long vertical members each other, with their short horizontal tips opposing in vertical direction, as shown in FIG. 2. When potentials applied to both conductive plates 460 and 461 are different from each other, a potential difference is given between adjacent two hooked-twig parts 460*b* and 461*b* to horizontally deflect the electron beams 17 having passed through the focusing electrode 45.

The vertical deflection electrodes 47 are made of conductive sheet which comprises a pair of conductive plates 47*a*, 47*b* as shown in FIG. 1. The conductive plate 47*a* is formed into a comb-shape wherein comb-teeth parts 470*a* and a stem part 470*b* connecting all the comb-teeth parts 470*a* are provided. The other conductive plate 47*b* is formed into a comb-shape wherein comb-teeth parts 471*a* and a stem part 471*b* connecting all the comb-teeth parts. 471*a* are provided. Both conductive plates 47*a* and 47*b* of the vertical deflection electrodes 47 are insulatedly disposed to each other on a common X–Y plane (in FIG. I) so that each of the comb-teeth parts 470*a* and each of the comb-teeth parts 471*a* are aligned opposing their long horizontal members each other, as shown in FIG. 1. When potentials applied to both conductive plates 47*a* and 47*b* are different from each other, a potential difference is given between adjacent two comb-teeth parts 470*a* and 471*a*, thereby vertically deflecting the electron beams 17 having passed through the horizontal deflection electrodes 46.

A fluorescent material layer which emits light at irradiation of the electron beams 17 is coated on an inner surface of the front glass plate 48, and a metal-back layer is attached on the fluorescent material layer thereby constituting the television picture screen 50. The television picture screen 50 has a picture effective area A which comprises center portions 50*a* and edge portions 50*b* divided in small segments 21 for displaying pictures.

Hereinafter, a set of the components for displaying one picture element in the small segment 21 is defined to one unit. Namely, the one unit comprises a part of the back electrode 41, the linear cathode 42*a*, 42*b*, 42*c* or 42*d*, the electron beam extraction electrode 43, the signal electrode 44, the focusing electrode 45, the horizontal deflection electrodes 46 and the vertical deflection electrodes 47 and the television picture screen 50 for displaying one picture element.

In the above-mentioned flat-type picture display apparatus, the horizontal deflection electrodes 46 have a pair of the hooked-twig parts 460*b* and 461*b* which are provided in the outside of the electron beam passing area E indicated by crosshatching in FIG. 2. In other words, a pair of the hooked-twig parts 460*b* and 461*b* is disposed at the position beyond the border lines α of the electron beam passing area E.

FIG. 3 is an enlarged sectional view showing the horizontal deflection electrodes 46 with the equipotential lines when the electron beams 17 are not deflected by the horizontal deflection electrodes 46. In the horizontal deflection electrodes 46, the electric field distribution on the electron beam passing area E has uniform electric field in each aperture between the facing hooked-twig parts 461*b* and 460*b* for one picture element. As shown in FIG. 3, the equipotential lines at each aperture between the facing hooked-twig parts 461*b* and 460*b* are produced to have uniform formation in the electron beam passing area E. Accordingly, the whole tracks of the electron beams 17 having passed through the horizontal deflection electrodes 46 in the electron beam passing area E are formed to be parallel with each other. Therefore, the track in the unit for the edge portion 50*b* is parallel with the track in the unit for the center portion 50*a* of the picture effective area A in the television picture screen 50.

Apart from the above-mentioned embodiment wherein, the horizontal deflection electrodes 46 are formed to have the same stem parts and the same hooked-twig parts in the outside of the electron beam passing area E as the stem parts 460*a*, 461*a* and the hooked-twig parts 460*b*, 461*b*, a modified embodiment may be such that horizontal deflection electrodes in the outside of the electron beam passing area E are formed to have a different shape from the above-mentioned first embodiment, such as a comb-shape comprising comb-teeth parts and stem parts which connect all the comb-teeth parts, so as to produce the substantially same equipotential surface between the edge portion 50*b* and the center portion 50*a* as the first embodiment.

Apart from the above-mentioned first embodiment wherein the horizontal deflection electrodes 46 are disposed between the focusing electrode 45 and the vertical deflection electrodes 47, a modified embodiment may be such that the horizontal deflection electrodes 46 are disposed between the signal electrodes 44 and the focusing electrode 45.

Second embodiment

Figure 4:
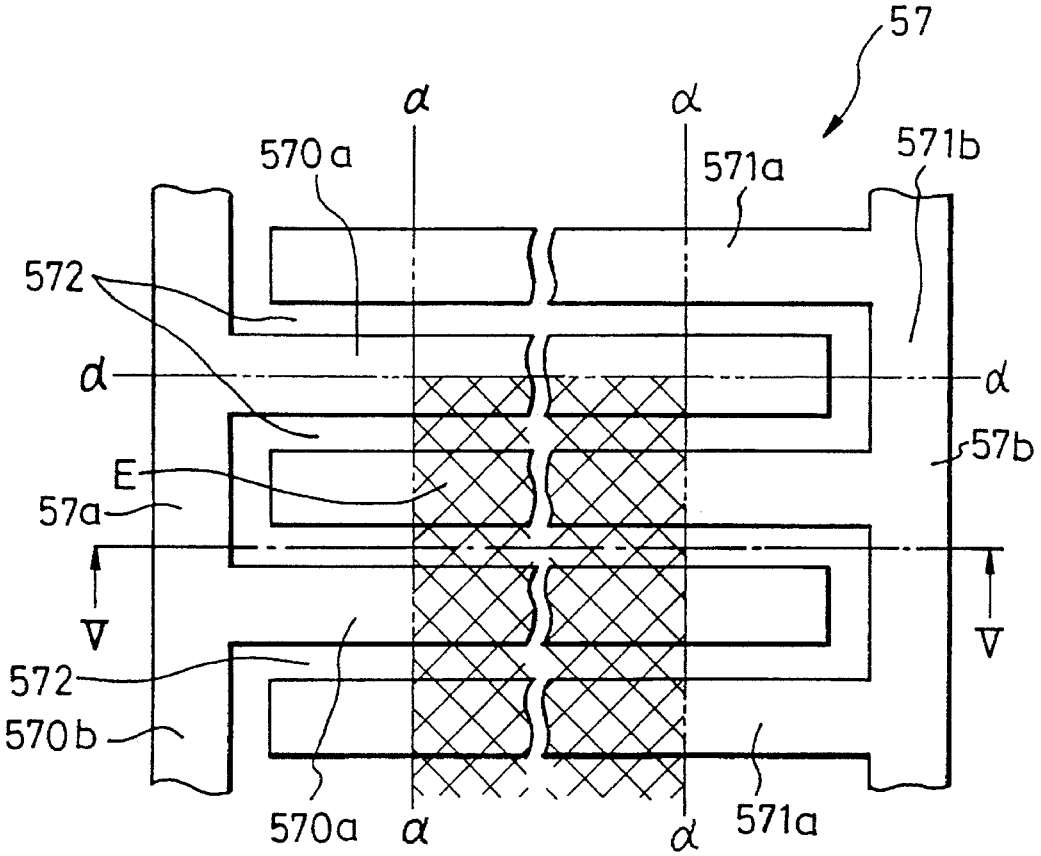
FIG. 4 is a front view showing a part of a vertical deflection electrode of a flat-type picture display apparatus of a second embodiment.
Figure 5:
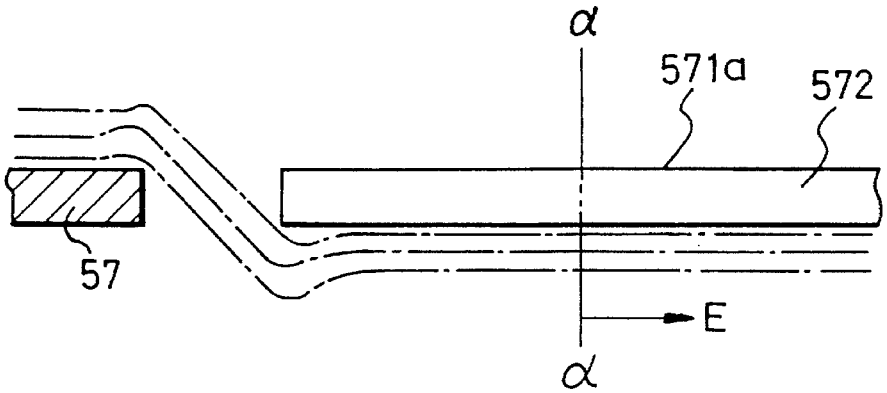
FIG. 5 is an enlarged sectional view taken on a line V—V of FIG. 4.

FIG. 4 is a front view showing a part of a vertical deflection electrodes 57 of a flat-type picture display apparatus of a second embodiment in accordance with the present invention. FIG. 5 is an enlarged sectional view taken on a line V—V of FIG. 4.

In the flat-type picture display apparatus of the second embodiment, a back electrode, linear cathodes, an electron beam extraction electrode, a signal electrode, a focusing electrode and a pair of horizontal deflection electrodes are constructed by same formation as the aforementioned first embodiment shown in FIG. 1.

In FIG. 4, the vertical deflection electrodes 57 are made of conductive sheets which are formed into comb-shapes, respectively. The vertical deflection electrode 57 comprises a pair of conductive plates 57*a* and 57*b*. One conductive plate 57*a* has comb-teeth parts 570*a* and a stem part 570*b* connecting all the comb-teeth parts 570*a*. The other conductive plate 57*b* has comb-teeth parts 571*a* and a stem part 571*b* connecting all the comb-teeth parts 571*a*. Both conductive plates 57*a* and 57*b* are insulatedly disposed to each other so that respective comb-teeth part 570*a* and respective comb-teeth part 571*a* are aligned opposing their long horizontal members each other to make horizontal apertures 572 aligned in parallel with each other at regular intervals correspond to each of the linear cathodes 42*a*, 42*b*, 42*c* and 42*d* as shown in FIG. 4. The apertures 572 are arranged at the center of the through-holes 45*a* of the focusing electrode 45.

A pair of comb-teeth parts 570*a* and 571*a* of the conductive plates 57*a* and 57*b* is provided in the outside of the electron beam passing area E which is surrounded by four border lines α, that is a left side border line α, a right side border line α, an upper side border line α and a lower side border line α (not shown). In other words, the aperture 572 between the comb-teeth parts 570*a* and 571*a* is disposed at the position beyond these border lines α of the electron beam passing area E indicated by crosshatching in FIG. 4.

In the above-mentioned vertical deflection electrodes 57, the electric field distribution on the electron beam passing area E has uniform electric field in each aperture between the facing comb-teeth parts 570*a* and 571*a* in the electron beam passing area E. FIG. 5 is an enlarged sectional view showing the vertical deflection electrode 57 with equipotential lines. As shown in FIG. 5, the equipotential lines on the aperture 572 between the comb-teeth parts 570*a* and 571*a* are produced to have an uniform formation in the electron beam passing area E. Therefore, the whole tracks of the electron beams 17 having passed through the vertical deflection electrodes 57 in the electron beam passing area E are formed to be parallel with each other.

Apart from the above-mentioned embodiment wherein, the vertical deflection electrodes 57 are formed to have the comb-teeth parts 570*a*, 571*a* and the stem parts 570*b*, 571*b* in the outside of the electron beam passing area E so that the conductive plates 57*a*, 57*b* are provided to extend beyond the border lines α in the horizontal direction and the conductive plates 57*a*, 57*b* are provided to be further disposed beyond the border lines α in the vertical direction, a modified embodiment may be such that vertical deflection electrodes in the outside of the electron beam passing area E are formed to have a different shape from the formation of the second embodiment, so as to produce the same electric field distribution on the vertical deflection electrodes in the whole electron beam passing area E as the vertical deflection electrodes 57 of the above-mentioned second embodiment.

Third embodiment

Figure 6:
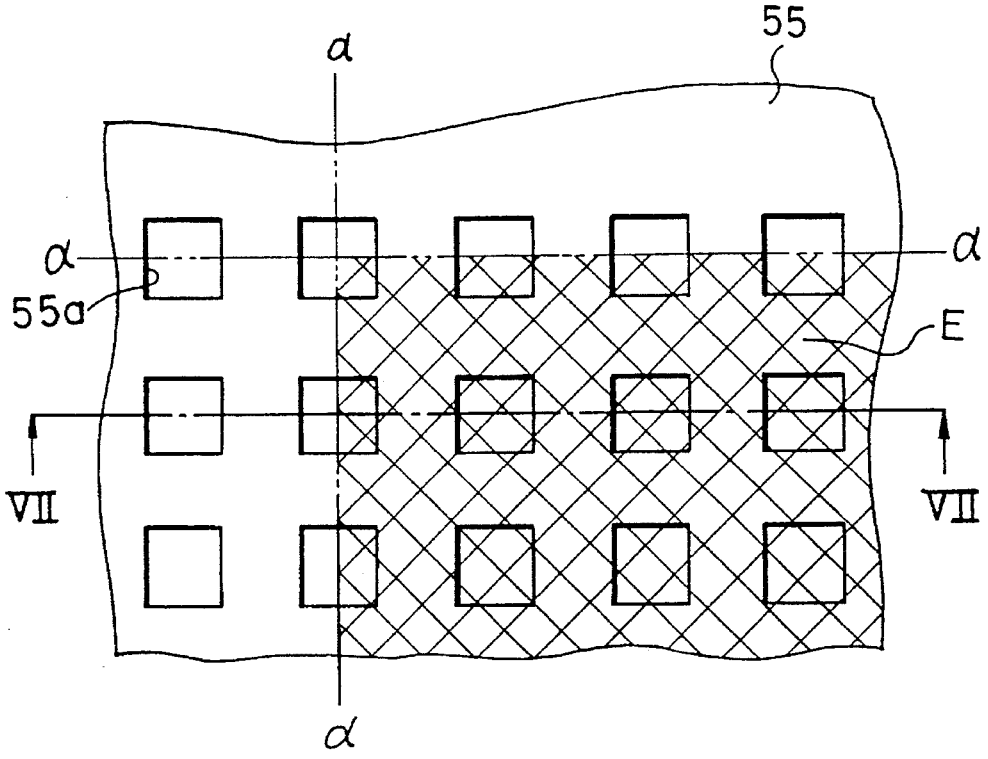
FIG. 6 is a front view showing a part of a focusing electrode of the flat-type picture display apparatus of a third embodiment.
Figure 7:
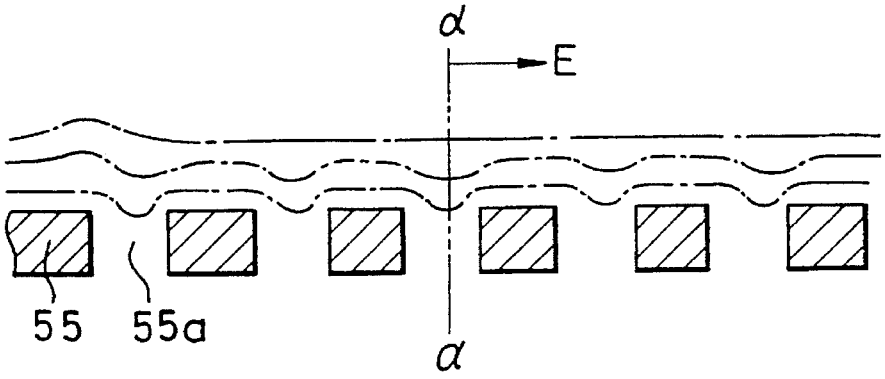
FIG. 7 is an enlarged sectional view taken on a line VII—VII of FIG. 6.
Figure 8:
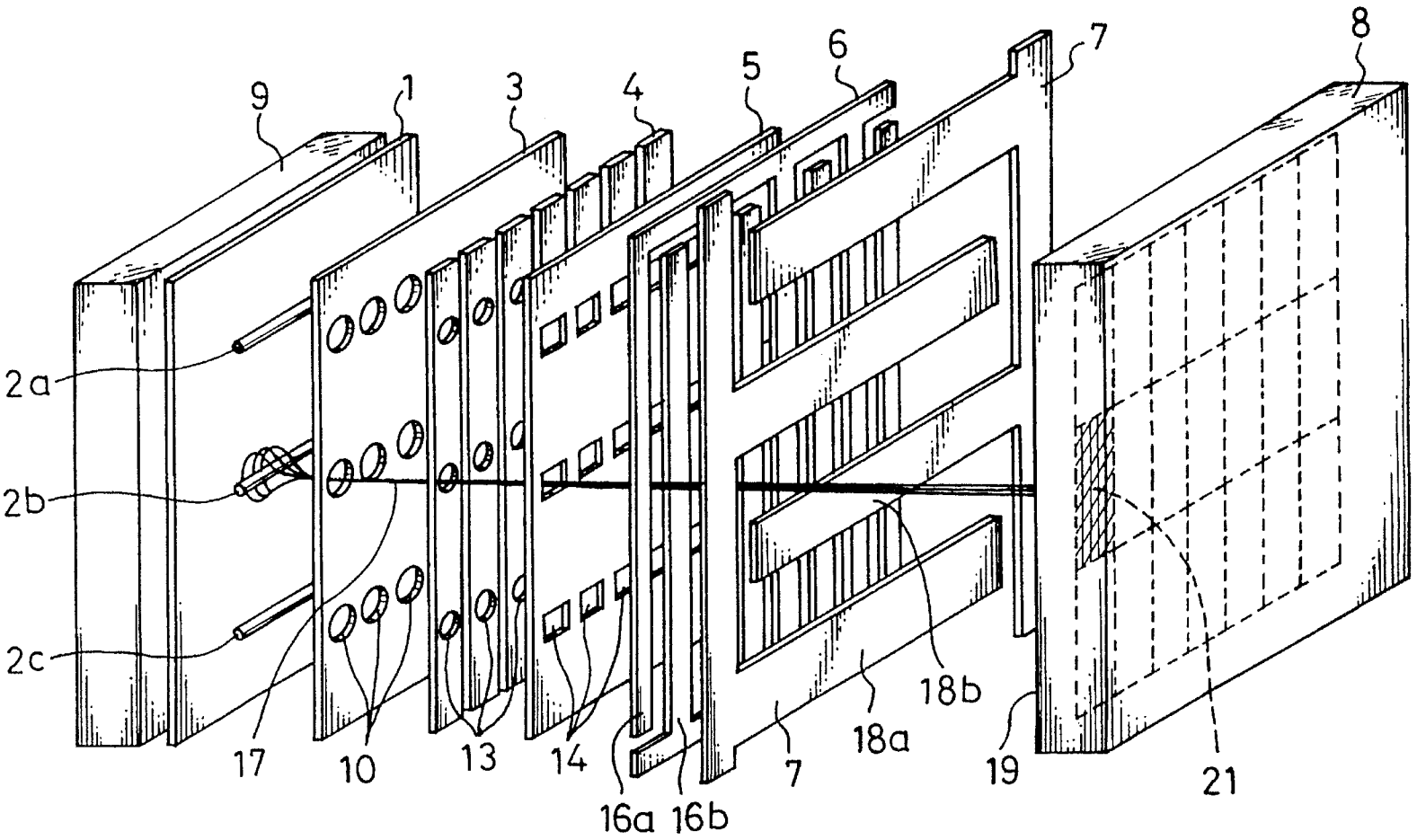
FIG.8 (Prior Art)
FIG. 8 is the exploded perspective view showing the internal conventional flat-type picture display apparatus.
Figure 9:
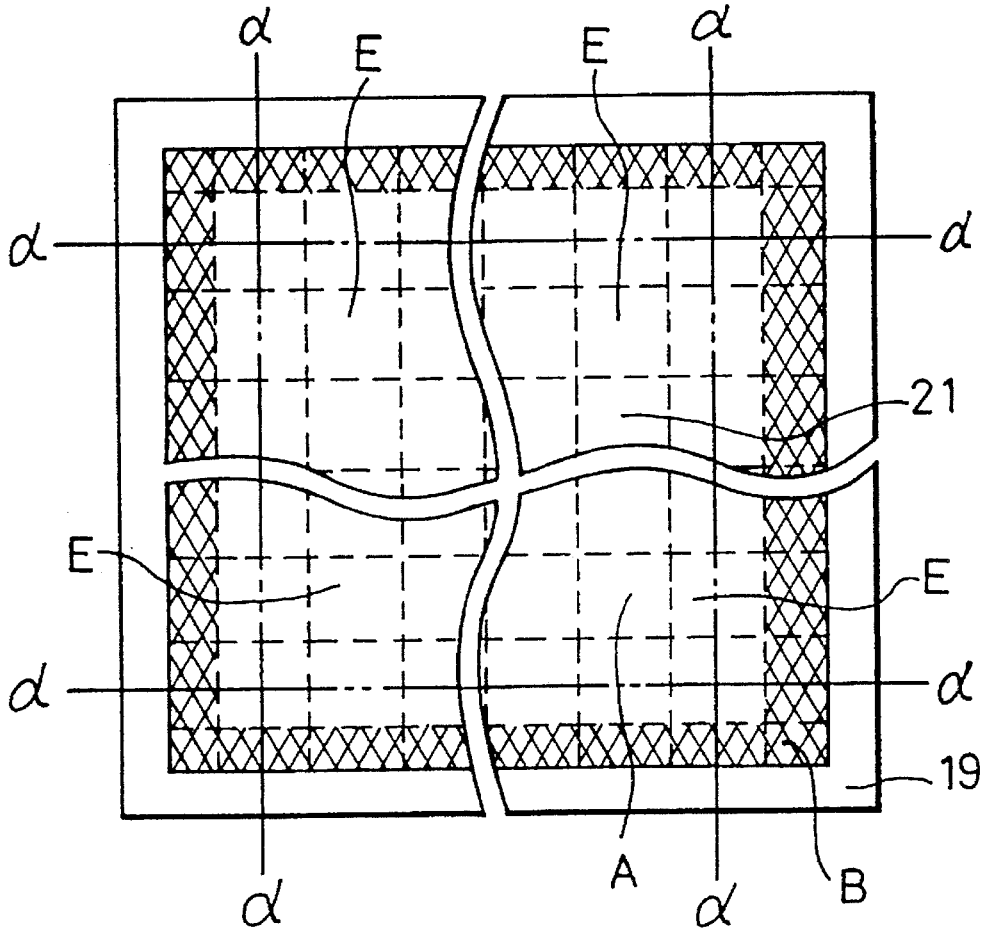
FIG.9 (Prior Art)
FIG. 9 is the schematic plan view of the television picture screen of the flat-type picture display apparatus.
Figure 10:
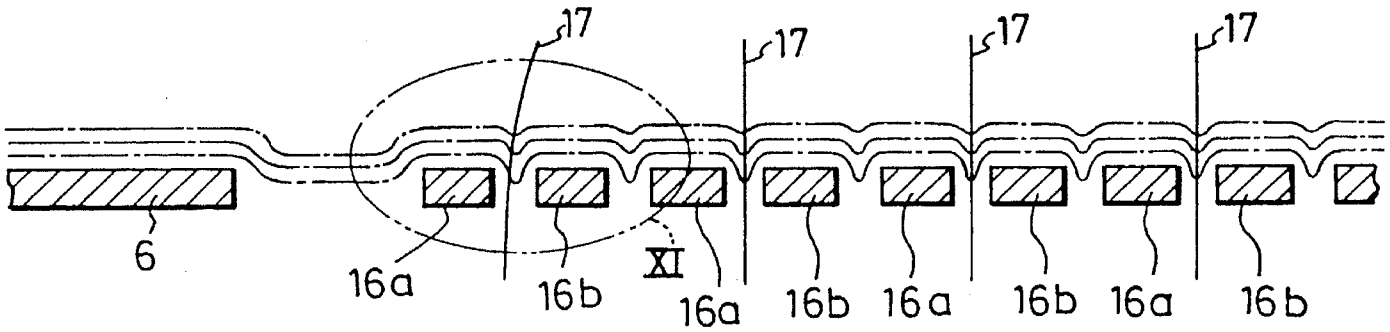
FIG.10(Prior Art)
FIG. 10 is the sectional view of the horizontal deflection electrode of the conventional flat-type picture display apparatus.
Figure 11:
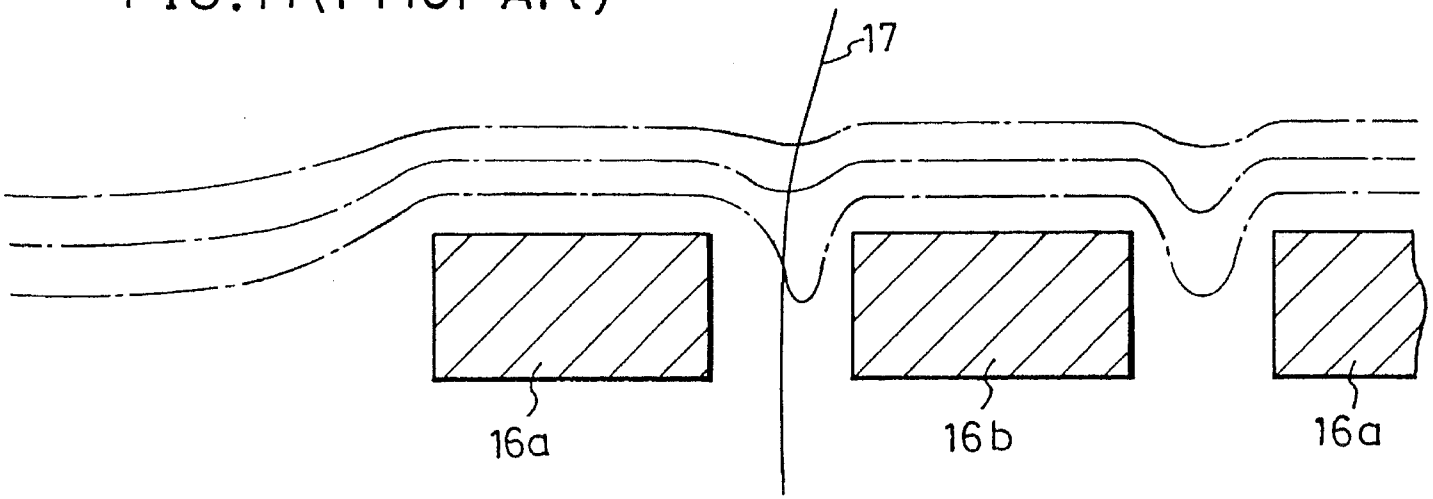
FIG.11(Prior Art)
FIG. 11 is the sectional view showing a part of the horizontal deflection electrode of FIG. 10.
Figure 12:
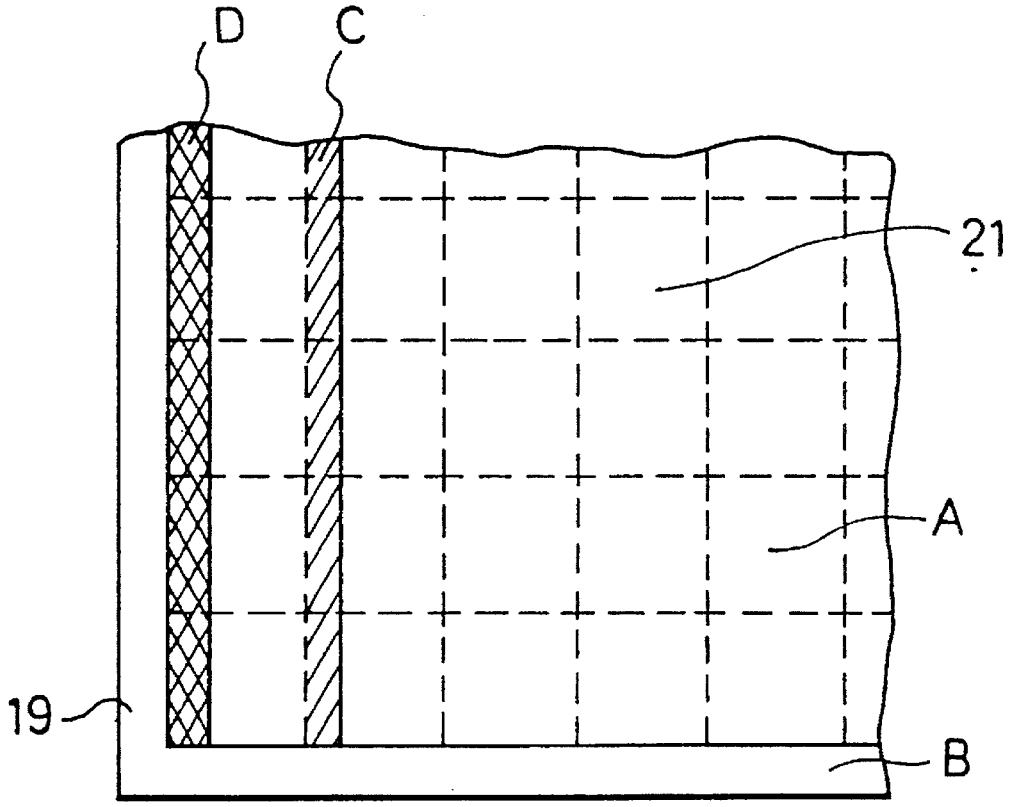
FIG.12 (Prior Art)
FIG. 12 is the plan view showing a part of the television picture screen of the conventional flat-type picture display apparatus.

FIG. 6 is a front view showing a part of a focusing electrode 55 of a flat-type picture display apparatus of a third embodiment in accordance with the present invention. FIG. 7 is an enlarged sectional view taken on a line VII—VII of FIG. 6.

In the flat-type picture display apparatus of the third embodiment, a back electrode, linear cathodes, an electron beam extraction electrode, a signal electrode, a pair of horizontal deflection electrodes and a pair of vertical deflection electrodes are constructed by same formation as the aforementioned first embodiment shown in FIG. 1.

In FIG. 6, the focusing electrode 55 is made of a conductive sheet and has plural rectangular through-hole 55*a* therein. The plural rectangular through-hole 55*a* are aligned in the horizontal direction at regular intervals to correspond to each of the linear cathodes and arranged to have same center point as the through-holes of the signal electrode.

In the third embodiment, the focusing electrode 55 are provided in the outside of the electron beam passing area E indicated by crosshatching in FIG. 6. In other words, the rectangular through-holes 55*a* are disposed at the position beyond the border lines α of the electron beam passing area E as shown in FIG. 6.

In the above-mentioned focusing electrode 55, the electric field distribution on the electron beam passing area E has uniform electric field in each of the rectangular through-holes 55*a* of the focusing electrode 55 in the electron beam passing area E. FIG. 7 is an enlarged sectional view showing the focusing electrode 55 with the equipotential lines. As shown in FIG. 7, the equipotential lines on each of the rectangular through-holes 55*a* of the focusing electrode 55 in the electron beam passing area E are produced to have an uniform formation. Therefore, the whole tracks of the electron beams having passed through the focusing electrode 55 are formed to be parallel with each other in the electron beam passing area E.

Apart from the above-mentioned embodiment wherein, the focusing electrode 55 is formed to have the same rectangular through-holes 55*a* in the outside and the inside of the electron beam passing area E, a modified embodiment may be such that through-holes in the outside of the electron beam passing area E are formed to have different shape from the rectangular through-holes of the above-mentioned third embodiment, so as to produce the same electric field distribution on the focusing electrode in the whole electron beam passing area E as the focusing electrode 55 of the above-mentioned third embodiment.

In the above-mentioned third embodiment, the focusing electrode 55 is provided to extend beyond the border lines α of the electron beam passing area E. But apart there from, a modified embodiment may be such that a pair of the conductive plates of the vertical deflection electrodes is provided to extend beyond the border lines α of the electron beam passing area E as the vertical deflection electrodes 57 of the aforementioned second embodiment.

According to the present invention, equivalent electric field distribution is produced on each unit of the vertical deflection electrodes, the horizontal deflection electrodes and the focusing electrode in the electron beam passing area E during the operation. And the equipotential surface on each of the electrodes is produced to have equivalent shape. Therefore, the electron beams for each unit trace in parallel with each other in the electron beam passing area E. As a result, the electron beams for the adjacent units in the edge portion of the picture effective area are not mixed, thereby whole television picture screen in the picture effective area is uniformly irradiated by the electron beams not to produce a brightening portion and a dark portion comparison with the circumference thereof. Accordingly, the flat-type picture display apparatus in accordance with the present invention can display pictures which have excellent uniformity.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A flat-type picture display apparatus comprising:

a generally planar back glass plate, a front glass plate generally disposed in a plane substantially parallel with respect to the back glass plate;

a plurality of linear cathodes extending generally parallel with respect to each other and disposed substantially in a plane generally parallel with respect to the glass plate;

a back electrode assembly disposed between the linear cathodes and the back glass plate in a plane generally parallel with respect to the back glass plate;

an electron beam extraction electrode assembly disposed between the linear cathodes and the front glass plate in a plane generally parallel with respect to the back glass plate, the electron beam extraction electrode assembly having a plurality of electron beam passing holes arranged into X rows and Y columns, each passing hole for extracting an electron beam from said linear cathodes and directing the electron beam toward the front glass plate;

a signal electrode assembly disposed between the electron beam extraction electrode assembly and the front glass plate in a plane generally parallel with respect to the back glass plate, the signal electrode assembly for controlling each electron beam directed from the electron beam extraction electrode assembly;

a focusing electrode assembly disposed between the electron beam extraction electrode assembly and the front glass plate in a plane generally parallel with respect to the back glass plate, the focusing electrode assembly for focusing each electron beam directed from the electron beam extraction electrode assembly;

a horizontal deflection electrode assembly disposed between the electron beam extraction electrode assembly and the front glass plate in a plane generally parallel with respect to the back glass plate, the horizontal deflection electrode assembly having a plurality of horizontal deflection aperture regions arranged into at least X+2 rows and at least Y+2 columns, the horizontal deflection aperture regions including a plurality of first regions and a plurality of second regions, the first regions forming a central zone and being arranged into X rows and Y columns, each first region corresponding to a passing hole in the electron beam extraction electrode assembly, the second regions forming a peripheral zone surrounding the central zone, each first region for horizontally deflecting the electron beam directed from the corresponding passing hole in the electron beam extraction electrode assembly:

a vertical deflection electrode assembly disposed between the electron beam extraction electrode assembly and the front glass plate in a plane generally parallel with respect to the back glass plate, the vertical deflection electrode assembly for vertically deflecting each electron beam directed from the electron beam extraction electrode assembly; and a fluorescent screen disposed on the front glass plate for receiving each electron beam.

2. A flat-type picture display apparatus in accordance with claim 1, wherein said horizontal deflection electrode assembly is disposed between said focusing electrode assembly and said vertical deflection electrode assembly.

3. A flat-type picture display apparatus in accordance with claim 1, wherein said horizontal deflection electrode assembly is disposed between said signal electrode assembly and said focusing electrode assembly.

4. A flat-type picture display apparatus in accordance with claim 1, wherein the focusing electrode assembly has a plurality of focusing aperture regions arranged into at least X+2 rows and at least Y+2 columns, the focusing aperture regions including a plurality of first regions and a plurality of second regions, the first regions forming a central zone and being arranged into X rows and Y columns, each first region corresponding to a passing hole in the electron beam extraction electrode assembly, the second regions forming a peripheral zone surrounding the central zone, each first region for focusing the electron beam directed from the corresponding passing hole in the electron beam extraction electrode assembly.

5. A flat-type picture display apparatus comprising:

a generally planar back glass plate, a front glass plate generally disposed in a plane substantially parallel with respect to the back glass plate;

plurality of linear cathodes extending generally parallel with respect to each other and disposed substantially in a plane generally parallel with respect to the back glass plate;

a back electrode assembly disposed between the linear cathodes and the back glass plate in a plane generally parallel with respect to the back glass plate;

an electron beam extraction electrode assembly disposed between the linear cathodes and the front glass plate in a plane generally parallel with respect to the back glass plate, the electron beam extraction electrode assembly having a plurality of electron beam passing holes arranged into X rows and Y columns, each passing hole for extracting an electron beam from said linear cathodes and directing the electron beam toward the front glass plate;

a signal electrode assembly disposed between the electron beam extraction electrode assembly and the front glass plate in a plane generally parallel with respect to the back glass plate, the signal electrode assembly for controlling each electron beam directed from the electron beam extraction electrode assembly;

a focusing electrode assembly disposed between the electron beam extraction electrode assembly and the front glass plate in a plane generally parallel with respect to the back glass plate, the focusing electrode assembly for focusing each electron beam directed from the electron beam extraction electrode assembly;

a horizontal deflection electrode assembly disposed between the electron beam extraction electrode assembly and the front glass plate in a plane generally parallel with respect to the back glass plate, the vertical deflection electrode assembly for horizontally deflecting each electron beam directed from the electron beam extraction electrode assembly;

a vertical deflection electrode assembly disposed between the electron beam extraction electrode assembly and the front glass plate in a plane generally parallel with respect to the back glass plate, the vertical deflection electrode assembly having a plurality of vertical deflection aperture regions arranged into at least X+2 rows and at least Y+2 columns, the vertical deflection aperture regions including a plurality of first regions and a plurality of second regions, the first regions forming a central zone and being arranged into X rows and Y columns, each first region corresponding to a passing hole in the electron beam extraction electrode assembly, the second regions forming a peripheral zone surrounding the central zone, each first region for vertically deflecting the electron beam directed from the corresponding passing hole in the electron beam extraction electrode assembly; and a fluorescent screen disposed on the front glass plate for receiving each electron beam.

6. A flat-type picture display apparatus in accordance with claim 5, wherein the horizontal deflection electrode assembly has a plurality of horizontal deflection aperture regions arranged into at least X+2 rows and at least Y+2 columns, the horizontal deflection aperture regions including a plurality of first regions and a plurality of second regions, the first regions forming a central zone and being arranged into X rows and Y columns, each first region corresponding to a passing hole in the electron beam extraction electrode assembly, the second regions forming a peripheral zone surrounding the central zone, each first region for horizontally deflecting the electron beam directed from the corresponding passing hole in the electron beam extraction electrode assembly.

7. A flat-type picture display apparatus comprising:

a generally planar back glass plate, a front glass plate generally disposed in a plane substantially parallel with respect to the back glass plate;

a plurality of linear cathodes extending generally parallel with respect to each other and disposed substantially in a plane generally parallel with respect to the back glass plate;

a back electrode assembly disposed between the linear cathodes and the back glass plate in a plane generally parallel with respect to the back glass plate;

an electron beam extraction electrode assembly disposed between the linear cathodes and the front glass plate in a plane generally parallel with respect to the back glass plate, the electron beam extraction electrode assembly having a plurality of electron beam passing holes arranged into X rows and Y columns, each passing hole for extracting an electron beam from said linear cathodes and directing the electron beam toward the front glass plate;

a signal electrode assembly disposed between the electron beam extraction electrode assembly and the front glass plate in a plane generally parallel with respect to the back glass plate, the signal electrode assembly for controlling each electron beam directed from the electron beam extraction electrode assembly;

a focusing electrode assembly disposed between the electron beam extraction electrode assembly and the front glass plate in a plane generally parallel with respect to the back glass plate, the focusing electrode assembly having a plurality of focusing aperture regions arranged into at least X+2 rows and at least Y+2 columns, the focusing aperture regions including a plurality of first regions and a plurality of second regions, the first regions forming a central zone and being arranged into X rows and Y columns, each first region corresponding to a passing hole in the electron beam extraction electrode assembly, the second regions forming a peripheral zone surrounding the central zone, each first region for focusing the electron beam directed from the corresponding passing hole in the electron beam extraction electrode assembly;

a horizontal deflection electrode assembly disposed between the electron beam extraction electrode assembly and the front glass plate in a plane generally parallel with respect to the back glass plate, the vertical deflection electrode assembly for horizontally deflecting each electron beam directed from the electron beam extraction electrode assembly;

a vertical deflection electrode assembly disposed between the electron beam extraction electrode assembly and the front glass plate in a plane generally parallel with respect to the back glass plate, the vertical deflection electrode assembly for vertically deflecting each electron beam directed from the electron beam extraction electrode assembly; and a fluorescent screen disposed on the front glass plate for receiving each electron beam.

8. A flat-type picture display apparatus in accordance with claim 7, wherein the vertical deflection electrode assembly has a plurality of vertical deflection aperture regions arranged into at least X+2 rows and at least Y+2 columns, the vertical deflection aperture regions including a plurality of first regions and a plurality of second regions, the first regions forming a central zone and being arranged into X rows and Y columns, each first region corresponding to a passing hole in the electron beam extraction electrode assembly, the second regions forming a peripheral zone surrounding the central zone, each first region for vertically deflecting the electron beam directed from the corresponding passing hole in the electron beam extraction electrode assembly.

9. A flat-type picture display apparatus in accordance with claim 8, wherein the horizontal deflection electrode assembly has a plurality of horizontal deflection aperture regions arranged into at least X+2 rows and at least Y+2 columns, the horizontal deflection aperture regions including a plurality of first regions and a plurality of second regions, the first regions forming a central zone and being arranged into X rows and Y columns, each first region corresponding to a passing hole in the electron beam extraction electrode assembly, the second regions forming a peripheral zone surrounding the central zone, each first region for horizontally deflecting the electron beam directed from the corresponding passing hole in the electron beam extraction electrode assembly.

* * * * *